United States Patent [19]

Wilton

[11] Patent Number: 4,473,722

[45] Date of Patent: Sep. 25, 1984

[54] ELECTROACOUSTIC TRANSDUCERS

[75] Inventor: Raymond J. Wilton, Brighton, England

[73] Assignee: Knowles Electronics Company, Eurgess Hill, United Kingdom

[21] Appl. No.: 385,715

[22] Filed: Jun. 7, 1982

[51] Int. Cl.[3] ..... H04R 11/00

[52] U.S. Cl. ..... 179/114 A; 179/115 A; 179/119 A

[58] Field of Search ..... 179/114 A, 115 A, 119 A

[56] References Cited

U.S. PATENT DOCUMENTS 3,313,892 4/1967 Mostardo, Jr. et al. ..... 179/115 A 3,935,398 1/1976 Carlson et al. ..... 179/114 A

*Primary Examiner*—Gene Z. Rubinson

*Assistant Examiner*—Danita R. Byrd

*Attorney, Agent, or Firm*—Leo J. Aubel

[57] ABSTRACT

A balanced armature electroacoustic transducer, including a pole piece formed of a stack of laminations and providing an opening or tunnel in which the vibratable end of a reed armature can vibrate between a pair of permanent magnets. A coil surrounds the central limb of the armature and the two outside limbs which provide the fixed end of the armature are located on flat faces of a pair of wings formed by the pole piece itself and accurately positioned in the same plane with the vibrating tip of the armature at the exact center of the air gap between the magnets.

9 Claims, 3 Drawing Figures

ELECTROACOUSTIC TRANSDUCERS

Figure 1:
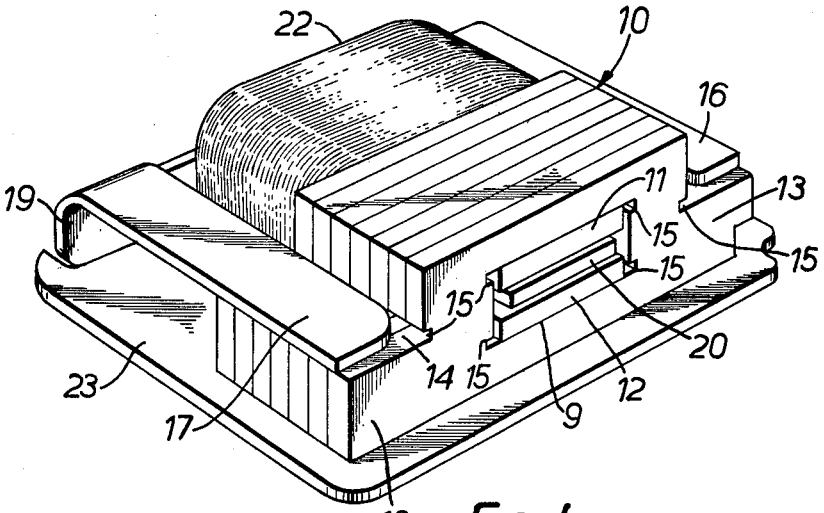

This invention relates to electroacoustic transducers as used in microphones for converting sound energy into electrical current or in loudspeakers or "receivers" for converting electrical currents into sound. The invention is particularly concerned with the type of transducer having a vibrating reed of the class known as "balanced armature".

In a balanced armature transducer a permanent magnet is combined with a pole piece to establish a magnetic field across an air gap and a vibratory reed is mounted with a part fixed and connected to the pole piece and another part capable of vibrating in the gap. The reed is surrounded by an electrical coil and the arrangement is such that when the moving part of the reed shifts in one direction or another away from a centralised position between the two poles the magnetic flux is caused to flow in one direction or the other along the reed and hence through the coil. The reed is attached to a diaphragm and in this way vibrations of the diaphragm caused by received sound are converted into corresponding currents in the coil, or vice versa.

In such balanced armature transducers it it important that the movable part of the reed should be accurately centralised in the air gap. Many proposals have been made to achieve this, but most prior systems are either inaccurate or extremely difficult to perform. Many such systems rely on bending of part of the pole piece or reed, either in the actual manufacturing process or in a subsequent adjusting stage. A further difficulty then arises from the inescapable movement which follows after adjustment when the stresses induced by bending are relieved.

Accordingly, it is an object of the present invention to provide an improved balanced armature transducer which will be relatively simply to manufacture and assemble, with an accurately centralised reed.

The invention is concerned with a balanced armature electroacoustic transducer of the type including two spaced magnets combined with a pole piece structure to provide a magnetic field across an air gap, a vibratory magnetic reed having one part fixed and magnetically connected to the pole piece structure and another part vibratable in the air gap, and a coil surrounding the reed, the arrangement being such that vibration of the reed in the air gap influences a current in the coil or vice versa.

From one aspect, the invention consists in a transducer of the type defined in which the pole piece structure is formed with an abutment surface to act as a location for the fixed part of the reed so as to locate the reed in relation to the air gap in the direction of vibration.

Preferably the abutment surface on the pole piece structure is displaced by half the thickness of the reed from the central plane of the air gap. Preferably also, the pole piece structure provides a ring surrounding the air gap and the locating abutment surface is preferably external to the ring.

In a particular preferred construction the reed is E-shaped with the two outer limbs lying approximately parallel and coplanar with the central limb, the outer limbs being secured to copolanar abutment surfaces on the pole ring and the central limb vibratable in the air gap. According to another preferred feature of the invention the pole piece structure is laminated and each of the laminations is shaped to provide a part of the abutment surface. The laminations may extent in planes perpendicular to the vibratory reed and each is of ring shape. Alternatively the laminations may extend parallel with the length of the reed.

In any case the transducer conveniently has two permanent magnets located respectively on opposite sides of the air gap and each connected to a part of the pole structure. From another aspect of the invention a transducer of the type defined has a laminated pole piece structure in which each of the laminations provides a complete magnetic flux path between opposite poles of the pole pieces and is also connected to the fixed part of the reed.

From yet another aspect of the invention, in a transducer as defined above the reed is either flat, or bent in such a way that relief of the bending stresses does not influence the position of the vibratable end of the reed.

According to another preferred feature of the invention the magnetic flux path extends through the same reed/pole piece junctions, when the reed vibrates in either direction, away from the mid position thereof.

Figure 2:
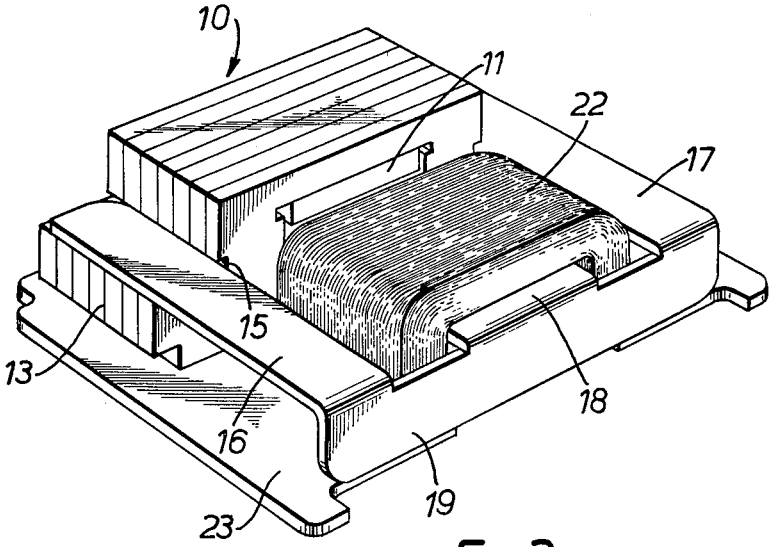
Figure 3:
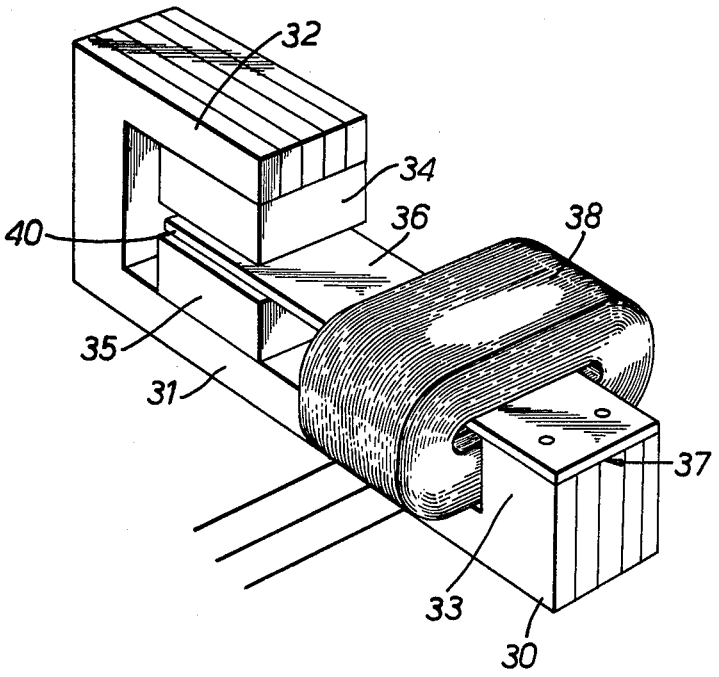

The invention may be performed in various ways and two embodiments will now be described by way of example with reference to the accompanying drawings, in which:

FIG. 1 is a simplified perspective view of one form of transducer according to the invention, FIG. 2 is another perspective view of the same transducer from the other end, and FIG. 3 is a perspective view of the second embodiment.

In the first example shown in FIGS. 1 and 2, the transducer comprises a pole piece stack or assembly 10 formed of a number of parallel flux conductive laminations with rectangular openings 9, assembled together side-by-side to form a central passageway or turnnel. Within this tunnel are located upper and lower permanent magnets 11,12 secured to the adjacent parts of the laminations and magnetised both in the same direction, vertically as seen in the drawings with the North Pole uppermost. This creates a strong magnetic field extending vertically across the air gap between the magnets, the field then dividing in the parts of the laminations above and below the magnets and looping round towards the further limb of the pole piece.

Each of the laminations is formed with a projecting wing 13 on each opposite side and each of the wings has a flat upper face 14 which is accurately positioned to lie parallel with but displaced by half the thickness of the central limb 18 of the armature from a central horizontal plane through the exact centre of the air gap between the magnets. It is possible that during manufacture the inside corners of the openings 9 and the wing 13 in the laminations may become radiussed, which could cause small errors in positioning the magnets 11,12 and the limbs 16, 17 of the armature. For this reason the corners are preferably formed with small undercuts as shown at 15.

The armature of the transducer is generally of E-shape with two lateral parallel limbs 16,17 and a central limb 18 which constitutes the vibrating reed. The part 19 of the armature which interconnects the three limbs is bent downwards at 90°, to improve the rigidity and reduce the overall dimensions. The ends of the two fixed limbs 16,17 are secured, for example, by welding to the flat faces 14 of the wings of the laminations. The tip 20 of the vibratory limb 18 is positioned between the two magnets 11,12 and the vibrating limb is surrounded by a coil 22 which may be mounted on the base plate 23 of the transducer. The vibrating limb 18 is connected by a link to a diaphragm (not illustrated) and the coil is connected to an amplifier if used as a microphone or to a supply circuit, if used as a receiver.

The three limbs 16,17,18 are all carefully and deliberately positioned in a common plane. Since the middle plane of the central limb tip 20 is required to be equally spaced from the two magnets 11,12 its top and bottom surface requires to be positioned by half the thickness of the limb about the mid position. This location is likewise adopted by the position of the face 14 on each pole piece lamination to support the undersurface.

It will be noted that each of the limbs 16,17,18 is bent with respect to the connecting limb 19, but the bending is in the same direction for each limb. Thus, as the bending stresses are relieved in one limb the same occurs in the others and hence the three limbs remain parallel in a common plane thus holding the tip 20 of the vibrating reed central in the air gap.

It will be noted that the pole piece laminations are not bent during manufacture and assembly as occurs in com prior transducers and the positioning faces 14 are accurately machined or stamped out of the laminations thus providing a positive locating face accurately positioned in relation to the top and bottom surfaces of the aperture 9. Any small inaccuracy in positioning the limbs 16 on the faces would not seriously affect the vertical positioning of the central reed tip 20.

In the second example illustrated in FIG. 3, the pole piece assembly 30 is generally of J-shape and again comprises a stack of flux conducting laminations each having a main limb 31 with a hook portion 32 at one end and an anvil 33 at the other end. A pair of permanent magnets 34,35 are positioned between the hook 32 and the main limb 31, the magnets being polarised in the same direction and spaced apart to form an air gap. The vibrating reed is a simple flat plate 36 secured rigidly at one end to the upper face 37 of the pole piece anvil 33 and with its other end centralised between the two magnets 34,35. The reed is surrounded by a coil 38 and attached by a link, not illustrated, to an acoustic diaphragm.

For the reasons given it is important that the moving end 40 of the reed should be accurately positioned centrally within the air gap. For this purpose the laminations of the pole pieces are so shaped in manufacture that the upper face 37 of the anvil lies coplanar with the under surface of the reed end 40 when it is centralised. Since the reed is a simple flat plate without bends and the pole piece laminations likewise are not bent in manufacture or assembly, there will be no relieving of stresses to introduce inaccuracies, and the assembly and accurate centralising of the reed require no special adjustment procedures.

It will be noted that in both these embodiments each individual lamination of the pole piece provides a complete flux path between the fixed and moving ends of the armature or reed. Also, it will be noted that when the direction of the magnetic flux along the reed alters, in use, the flux continues to pass in either direction through the same junctions between the armature and the pole piece laminations. Thus any difference in the magnetic qualities of the welds or junctions will not affect the operation of the device.

I claim:

1. A balanced armature electroacoustic transducer, including two permanent magnets, each said magnet having one surface adjacent to but spaced from a corresponding surface of the other magnet to define an air gap, and each magnet also having a further opposed surface remote from the other magnet, a pole piece structure directly contacting the opposed remote surfaces of said magnets to form a magnetic flux circuit, which provides a magnetic field across said air gap, a vibratory magnet reed having one part fixed and directly connected to an abutment surface on said pole piece structure and another part vibratable in said air gap and a further part extending between said abutment surface and said air gap, and a coil surrounding said reed, whereby vibration of the reed in the air gap influences a current in the coil and vice versa, and in which the abutment surface on said pole piece structure lies in a plane passing through said air gap approximately midway between said magnets, and the part of said reed between said abutment surface and said air gap, is flat.

2. A transducer according to claim 1, in which said abutment surface on the pole piece structure is accurately spaced by one half the thickness of said reed from the central plane of the air gap located midway between said magnets.

3. A transducer according to claim 1, in which said pole piece structure provides a ring surrounding the air gap.

4. A transducer according to claim 3, in which said abutment surface is external to said ring.

5. A transducer according to claim 3, in which said reed is E-shaped having two outer limbs lying approximately parallel with a central limb, said outer limbs being secured to said abutment surfaces on the pole ring, wherein said abutment surfaces are coplanar and said central limb vibratable in the air gap.

6. A transducer according to claim 1, in which said pole piece structure is laminated and each of the laminatins is shaped to provide a part of said abutment surface.

7. A transducer according to claim 6, in which the laminations of the stack extend in planes perpendicular to said vibratory reed and each is of ring shape.

8. A transducer according to claim 7, in which the laminations of the stack extend parallel with the length of said reed.

9. A transducer according to claim 1, in which the magnetic flux path extends always through the same reed/pole piece junctions, when said reed vibrates, both above and below the mid position of said reed.

* * * * *

UNITED STATES PATENT AND TRADEMARK OFFICE

CERTIFICATE OF CORRECTION

PATENT NO. : B1 - 4,473,722
DATED : Sept. 25, 1984
INVENTOR(S) : Raymond J. Wilton It is certified that error appears in the above-indentified patent and that said Letters Patent is hereby corrected as shown below:

At column 1, line 23, please delete the words --*the* magnets to form a magnetic [surfaces] *surface* of [said]--.

At column 2, lines 4 through 7 should read as follows:

--*abutment surface of the* pole piece structure, and another part vibratable in [said] *the* air gap and a further part extending between [said abutment surface and said air gap,]--

Signed and Sealed this
Thirty-first Day of October 1995

*Attest:*

*Attesting Officer*

Bruce Lehman

BRUCE LEHMAN

*Commissioner of Patents and Trademarks*

US004473722B1

REEXAMINATION CERTIFICATE (2602nd)

United States Patent [19]

Wilton

[11] B1 4,473,722

[45] Certificate Issued Jun. 20, 1995

[54] ELECTROACOUSTIC TRANSDUCERS

[75] Inventor: Raymond J. Wilton, Brighton, England

[73] Assignee: Knowles Electronics Co., Burgess Hill, United Kingdom

Reexamination Request:
No. 90/003,167, Aug. 19, 1993

Reexamination Certificate for:

| | |
|---|---|
| Patent No.: | **4,473,722** |
| Issued: | **Sep. 25, 1984** |
| Appl. No.: | **385,715** |
| Filed: | **Jun. 7, 1982** |

[51] Int. Cl.[6] ..... H04R 25/00
[52] U.S. Cl. ..... 381/200
[58] Field of Search ..... 381/200, 201, 199, 194, 381/192

[56] References Cited

U.S. PATENT DOCUMENTS

| | | | |
|---|---|---|---|
| Re. 15,993 | 2/1925 | Peterson | 381/200 |
| 1,523,540 | 1/1925 | Hecht | 381/200 |
| 1,830,755 | 11/1931 | Fitch | 381/201 |
| 1,912,078 | 5/1933 | Hunter et al. | 381/200 |
| 3,111,563 | 11/1963 | Carlson | 381/200 |
| 3,313,892 | 4/1967 | Mostardo, Jr. et al. | 381/200 |
| 4,410,769 | 10/1983 | Tibbets . | |

FOREIGN PATENT DOCUMENTS

| | | |
|---|---|---|
| 1158115 | 11/1963 | Germany . |
| 4116005 | 6/1964 | Japan . |
| 4210181 | 6/1967 | Japan . |
| 51-58324 | 5/1976 | Japan . |
| 58-54199 | 4/1983 | Japan . |

*Primary Examiner*—Curtis A. Kuntz

[57] ABSTRACT

A balanced armature electroacoustic transducer, including a pole piece formed of a stack of laminations and providing an opening or tunnel in which the vibratable end of a reed armature can vibrate between a pair of permanent magnets. A coil surrounds the central limb of the armature and the two outside limbs which provide the fixed end of the armature are located on flat faces of a pair of wings formed by the pole piece itself and accurately positioned in the same plane with the vibrating tip of the armature at the exact center of the air gap between the magnets.

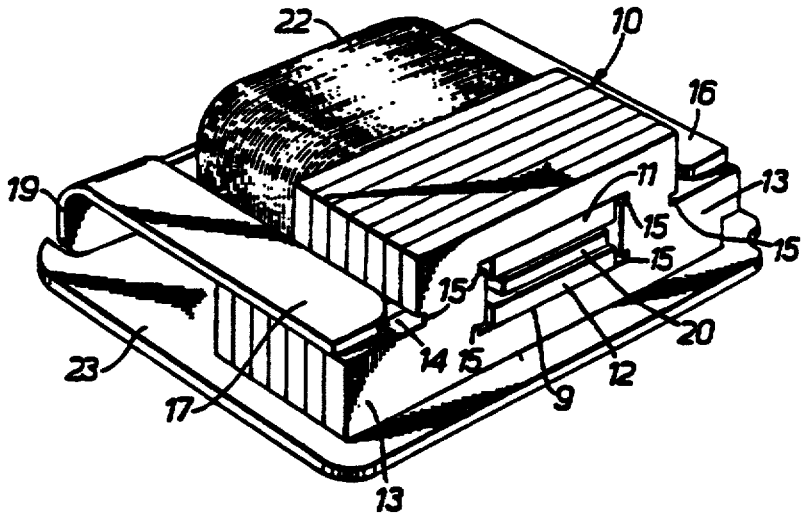

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 8 are determined to be patentable as amended.

Claims 2–7 and 9 dependent on an amended claim, are determined to be patentable.

New claim 10 is added and determined to be patentable.

1. A balanced armature electroacoustic transducer, including two permanent magnets, each said magnet having one surface adjacent to but spaced from a corresponding surface of the other magnet to define an air gap[,] and each magnet also having a further opposed surface remote from the other magnet, a pole piece structure *having an interior and an exterior surface, said exterior surface defining a reed abutment surface, and said interior surface* directly contacting the opposed remote surface[s] of [said] *the* magnets to form a magnetic [surfaces]*surface* of [said] *the* magnets to form a magnetic flux circuit[,] which provides a magnetic field across [said] *the* air gap, a vibratory [magnet] *magnetic* reed having one part fixed [and directly connected to an abutment surface on said] *to the reed abutment surface of the* pole piece structure, and another part vibratable in [said] *the* air gap and a further part extending between [said abutment surface and said air gap], *the one part and another part, the one and another parts of the reed being flat and coplanar,* and a coil surrounding [said] *the* reed, [whereby] *the arrangement being such that* vibration of the reed in the air gap influences a current in the coil and vice versa, [and in which the abutment surface on said pole piece structure] *the reed abutment surface* lies in a plane passing through [said] *the* air gap [approximately midway between said magnets, and the part of said reed between said abutment surface and said air gap, is flat] *displaced from the central plane of the air gap by a distance approximately equal to half the thickness of the reed, the pole piece structure is rigid and directly contacts the opposed remote surfaces of said pair of permanent magnets and the one part of the reed, and the pole piece structure is formed of unitary laminations which extend continuously between and whose edges provide the abutment surface for the reed and the mounting surfaces for the magnets, each lamination lying in a plane perpendicular to the plane of the another part of the reed, whereby the another part of the reed is accurately centered within the air gap.*

8. A transducer according to claim [7] *6,* in which the laminations of the stack extend parallel with the length of said reed.

*10. A transducer according to claim 1 wherein the pole piece structure is so shaped and arranged that, DC flux produced by the magnets does not pass through the one part of the reed.*

* * * * *